United States Patent [19]

Mahieu

[11] Patent Number: 4,958,052

[45] Date of Patent: Sep. 18, 1990

[54] ARC SEVERING AND DISPLACEMENT METHOD AND APPARATUS FOR FAULT CURRENT INTERRUPTION

[76] Inventor: William R. Mahieu, Rural Rte. 4, P.O. Box 23, Centralia, Mo. 65240

[21] Appl. No.: 454,705

[22] Filed: Dec. 18, 1989

Related U.S. Application Data

[63] Continuation-in-part of Ser. No. 310,794, Feb. 14, 1989, Pat. No. 4,904,977.

[51] Int. Cl.[5] ..... H01H 33/70

[52] U.S. Cl. ..... 200/148 R; 200/144 C; 200/148 G; 200/149 A

[58] Field of Search ..... 200/148 R, 148 A, 148 B, 200/148 G, 149 A

[56] References Cited

U.S. PATENT DOCUMENTS

| | | | |
|---|---|---|---|
| 2,051,478 | 8/1936 | Hampton et al. | 200/144 |
| 2,133,938 | 10/1938 | Ruppel | 200/148 |
| 2,223,975 | 12/1940 | Traver | 200/149 |
| 2,294,801 | 9/1942 | Rawlins | 200/149 |
| 2,349,095 | 5/1944 | Henley | 200/148 |
| 2,365,509 | 12/1944 | Baker | 200/149 |
| 3,544,747 | 12/1970 | Boersma et al. | 200/148 |
| 3,884,542 | 5/1975 | Flatt | 339/111 |
| 3,909,570 | 9/1975 | Harner et al. | 200/144 C |
| 4,110,580 | 8/1978 | Farish | 200/148 C |
| 4,192,572 | 3/1980 | Stanger et al. | 339/111 |
| 4,224,490 | 9/1980 | Frind | 200/148 R |
| 4,259,556 | 3/1981 | Kii | 200/148 R |
| 4,271,339 | 6/1981 | Meister et al. | 200/144 C |
| 4,296,289 | 10/1981 | Wuthrich et al. | 200/148 R |
| 4,341,933 | 7/1982 | Keller | 200/148 R |
| 4,418,256 | 11/1983 | Graf | 200/148 R |
| 4,420,662 | 12/1983 | Niemeyer et al. | 200/148 R |
| 4,471,185 | 9/1984 | Kinsinger | 200/148 R |
| 4,517,425 | 5/1985 | Martin | 200/148 A |
| 4,553,008 | 11/1985 | Veverka et al. | 200/148 R |

FOREIGN PATENT DOCUMENTS

| | | |
|---|---|---|
| 1422551 | 1/1965 | France . |

*Primary Examiner*—Robert S. Macon

[57] ABSTRACT

Current interrupters for high voltage networks are disclosed which sever the post-zero arc plasma, connecting a pair of arc terminating electrodes, near an upstream wall electrode and displace the severed plasma with a high dielectric strength gas, gaining dielectric strength faster than the transient network voltage recovers across the lengthening plasma discontinuity. Use of a high enthalpy dielectric displacement gas, created at the time of load or fault current interruption, makes plasma severing and displacement possible. High enthalpy displacement gas mixtures are preferably produced by combustion of solid propellants and/or ablation of solids rich in hydrogen.

21 Claims, 5 Drawing Sheets

ARC SEVERING AND DISPLACEMENT METHOD AND APPARATUS FOR FAULT CURRENT INTERRUPTION

RELATED APPLICATIONS

This is a continuation-in-part of U.S. patent application Ser. No. 07/310,794 filed Feb. 14, 1989, now U.S. Pat. No. 4,904,977, the disclosure of which is herein incorporated by reference.

BACKGROUND OF THE INVENTION

1. Field of the Invention

The present invention pertains to current interrupting devices, and especially to those devices for power class high voltage circuits, which are capable of interrupting a fault current.

2. Description of the Related Art

Apparatus for terminating an overload or overcurrent condition in a high voltage power class network must extinguish or otherwise interrupt electrical arcs that are developed as the overload current path is broken. In many types of devices, the arc is developed between a pair of separating electrodes, one or both of which are mounted for movement away from one another. Moveable electrode arrangements are disclosed in U.S. Pat. Nos. 2,051,748; 2,223,975; 3,884,542; 4,192,572; and 4,271,339. Some of these utilize gas pressure developed by the heat of the resulting arc, to assist in the electrode's separation. Mechanical assistance is provided in U.S. Pat. No. 4,553,008 where energy stored in a coil spring assist in driving the electrodes apart. Other arrangements, such as those disclosed in U.S. Pat. Nos. 2,294,801 and 3,909,570 use gas evolving material to assist in quenching the resulting arc.

So-called fluid blast devices such as those disclosed in U.S. Pat. Nos. 2,365,509; 4,224,490; and 4,243,860 use high pressure fluid flows between the separating electrodes to quench the arc formed therebetween. At times, composite structures are associated with one or both electrodes to also provide an evolution of arc quenching gas adjacent one of the electrodes. For example, U.S. Pat. No. 2,365,509 discloses a fluid blast interrupter in which horn fiber is positioned adjacent one electrode to evolve an arc quenching gas immediately adjacent the electrode. Many current interrupting devices used today, and proposed in the past, have limited the arc quenching fluid to a gas and substantial quantities of a dielectric gas are directed at an arc, within a short time after its formation. Devices such as those disclosed in U.S. Pat. No. 4,517,425 utilize negative pressures developed in the apparatus to operate check valves controlling the flow of a dielectric gas.

Several patents provide a blast of dielectric gas to disrupt the arc formed between a pair of electrodes. The patents referred to include U.S. Pat. Nos. 2,133,938; 2,349,095; 3,544,747; 4,110,580; 4,259,556; 4,296,289; 4,418,256; 4,420,662; and 4,471,185. In addition, French Patent No. 1,422,551 also discloses a current interrupting device which uses gaseous dielectric fluids, such as sulphur hexaflouride. The last mentioned U.S. Pat. No. 4,471,185 provides a controlled transition of the gas blast from subsonic to supersonic velocities in a gas flow which is initially directed generally perpendicular to the path of the separating electrodes, but which quickly follows the direction of electrode separation.

U.S. Pat. No. 4,341,933 also discloses a gas blast in directions which, at least initially, are not parallel to the path of separating electrodes. In this patent, a pair of opposed gas streams are directed to a path of separation of opposed electrodes, so as to create a controlled flow pattern at a point in the electrode path where arcing is expected to occur during current interruption. Due to the relative dimensions of the electrodes and the cylindrical-type housing in which the electrodes travel, the gas blast travels in a direction generally parallel to that of the forming arc. Indeed, it has been observed that, in general, all of the current interrupting devices referred to above are arranged such that the forming arc and the resulting turbulent flow of the insulating medium are generally parallel to one another.

An attempt is made with devices such as those described above, to cool the outside of the arc plasma rapidly enough following a current-zero so as to avoid a continuation of arcing during a subsequent transient voltage recovery between the electrodes. However, despite precautions, many current interrupting devices in use today have been found to be susceptible to two defined failure modes. In one failure mode, the arc, i e., the plasma between the electrodes is not completely dissipated and a resulting residual plasma conductivity allows relatively small current flows which are sufficient to create substantial Joule heating during the first few dozen microseconds after a current zero.

Many of the devices in use today employ dielectric gases travelling at supersonic velocities in an effort to obtain the desired rate of cooling. A gas flow surrounding the arc and travelling axially therewith cools the interelectrode residual plasma, primarily by convection in the subsonic regions and by turbulent diffusion in the supersonic regions of gas flow. If the interrupter cools the residual plasma faster than the rate of Joule heating caused by the rising system voltage and small post-zero fault current, thermal reignition of the arc is avoided. At present, the thermal reignitions are thought to be governed by the rate of rise in transient recovery voltage, which is highest for short line faults occurring only a small distance from the interrupter.

The combination of electrons, ions and atoms surrounding the arc converts the plasma to a high temperature dielectric gas. Transient recovery voltages may produce a dielectric breakdown in the hot gas, resulting in a dielectric reignition of the arc. Dielectric reignitions at present, are thought to be governed by the peak recovery voltage of a system and have been observed to be the limiting mode of failure for faults occurring near the terminal of the interrupter.

It has been found during the course of development of the present invention that thermal and dielectric fault interrupting performance of many present day circuit breakers causes the breakers to have relatively low fault current ratings because the diameter of the residual arc at current zero increases with increasing fault current. Accordingly, more time is required to cool the larger diameter residual arc from the outside surface by turbulent diffusion. Thus, thermal reignitions are experienced at lower rates of rise of transient recovery voltage and dielectric reignitions are experienced at lower peak voltages.

Accordingly, there is a need to provide further improvements in current interrupter performance, specifically in air insulated devices.

SUMMARY OF THE INVENTION

It is an object according to the present invention to provide means for improving the performance of current interrupting devices for high voltage networks or systems.

In particular, it is an object to improve the performance of air insulated current interrupting devices wherein the high network voltage, which appears across the device after current interruption, is insulated by atmospheric air.

It is an object according to the present invention to provide a current interrupting apparatus which severs an arc extending between a pair of electrodes, and quickly displaces the severed arc portion away from at least one electrode so as to continuously lengthen the resulting dielectric gap.

Another object according to the present invention is to provide a current interrupting apparatus of the above-described type in which the dielectric strength of the gap between the severed arc portions continuously exceeds the transient recovery voltage between the severed arc portions.

A further object according to the present invention is to provide an apparatus of the above-described type which employs transverse flow of a dielectric gas across the upstream or high pressure terminated arc portion to subject the arc terminus to a flow field having both translational and rotational fluid motion to stretch and segment the terminated arc during the first few microseconds following a current zero, when the transient recovery voltage is near zero.

It is an object according to the present invention to provide current interrupting apparatus wherein a dielectric gas is used for current interruption and recovery voltage withstand which has a high absolute stagnation enthalpy, preferably obtained through a low average molecular weight and high absolute temperature, and moderate stagnation and flow pressures.

One object of the present invention is to provide a dielectric interrupting gas which is formed from solid materials at the time of current interruption.

Another object according to the present invention is to provide current interrupting apparatus of the above-described type which uses a converging nozzle adjacent an upstream electrode whereat the arc is severed, in order to augment such arc severing.

Yet another object according to the present invention is to provide current interrupting apparatus of the above-described type which maintains near-sonic velocities and flow pressures over the lengthening dielectric gap until the peak transient recovery voltage stress has passed.

Another important object according to the present invention is to provide high voltage, current interrupting apparatus of the above-described type which may also retain and improve the turbulent cooling means used in present-art interrupters.

These and other objects according to the present invention which will become apparent from studying the appended description and drawings are provided in an apparatus for interrupting currents in a high voltage network, comprising:

Apparatus for interrupting currents in a high voltage network, comprising:

a source of a dielectric gas adapted for extinguishing an electric arc;

conduit means defining a confined channel for conveying said dielectric gas along a path from said source through the confined channel;

a first electrode disposed in said conduit means having an exposed surface in said confined channel generally parallel to the direction of gas flow therethrough;

a second electrode in conductive relation with said first electrode during normal operation and disposed downstream from said first electrode at the time of current interruption;

said first and second electrodes having means for conductive connection to a current path in the high voltage network;

a dielectric surface exposed in said confined channel generally parallel to the direction of gas flow therethrough, downstream from said first electrode and contiguous with the exposed surface of said first electrode to form a substantially continuous surface; and means for releasing said dielectric gas from said source when the current in the network approaches zero so as to impart high velocity flow of the dielectric gas over said substantially continuous surface along a path intersecting an electrical arc formed between said first and second electrodes and so as to sever the electrical arc from said first electrode, and displace the severed arc portion toward said dielectric surface.

Other objects according to the present invention are provided in a current interrupting apparatus, generally of the above-described type, but in which a converging nozzle is provided adjacent the first electrode, either upstream or downstream thereof.

As will be seen, the present invention provides novel methods and apparatus for withstanding transient system recovery voltage in an electrical breaker, wherein the electrical continuity of an interelectrode arc plasma is lost across a turbulent flow boundary, near the arc root, at the upstream throat electrode. The severed plasma is thereafter displaced downstream by high dielectric strength gas at near sonic velocity and high flow pressure, with the plasma discontinuity thereby gaining dielectric strength more rapidly than the transient system voltage recovers across the ever lengthening discontinuity. This means of dielectric recovery is referred to in this application as plasma or arc severing and displacement to distinguish from plasma cooling, the fundamental dielectric recovery mechanism in present-art high voltage, current-zero fault interrupters.

In one of its aspects, the present invention terminates post-zero current and Joule heating in less time (typically, a few microseconds) than in conventional circuit breakers (usually tens of microseconds), making thermal arc reignition at the lower transient recovery voltages less likely. The present invention prevents dielectric arc reignitions by maintaining the near sonic displacement of the severed plasma with high dielectric strength gas until passage of the peak transient recovery voltage stress across the lengthening dielectric gap. The better prior art circuit breakers use supersonic turbulent cooling of a residual plasma column for both thermal and dielectric recovery.

The present invention, which is novel in recognizing that the extinguishing gas enthalpy is the most direct sensitive indicator of arc quenching performance, uses a higher enthalpy gas in an efficient manner to facilitate arc severing and displacement. Additional advantages are also realized in that it also increases the thermal diffusivity of the plasma and dielectric interrupting gas, significantly decreasing the time to cool post-zero residual plasma by the prior art means of turbulent heat diffusion. Thus, the preferred arc severing and displacement means of the present invention can optionally be used in physical and electrical series with conventional supersonic turbulent cooling means to obtain synergistic improvements in current interrupting performance of high voltage interrupters.

Also, the disclosed methods and apparatus for current interruption in high voltage networks will significantly increase the performance of air insulated devices such as circuit breakers, expulsion fuses and switches.

In a preferred embodiment, a first electrode is arranged immediately adjacent a converging nozzle so that the continuity of the interelectrode plasma is severed adjacent the termination of the high pressure end of the arc to a ring-shaped first electrode at the throat of the converging nozzle. A downstream adjacent and preferably contiguous dielectric surface is also in contact with the same gas flow and a common flow boundary layer which cuts across arc plasma emanating from the first electrode and which covers both the first, upstream electrode and the downstream adjacent dielectric surface. This arrangement provides the advantages of causing the arc to traverse a thin, high shear flow boundary near the arc root formed at the first electrode.

As described above, principles of the present invention may be embodied in a flow confining duct located downstream of a flow-confining first electrode, preferably one having a ring-like configuration and a surface disposed in the gas flow, with the electrode surface and the dielectric surface comprising portions of a flow-confining duct. The present invention is also directed to a central, axially located, flow-contacting elongate member, preferably made of dielectric material, at least partly disposed within an outer surrounding duct. This alternative embodiment, preferably includes a cylindrical electrode upstream of a contiguous dielectric cylinder having a streamlined downstream portion which preferably follows a contour which terminates at a point. An arc-quenching gas flow, confined by the outer surrounding duct, passes over the electrode surface and the adjacent and preferably contiguous dielectric surface and is confined at the aforementioned common boundary layer.

An arc emanating from the electrode crosses the common boundary layer and, given appropriate gas flow dynamic forces, is severed from the electrode near the arc root, that portion of the arc adjacent the electrode. The severed portion is displaced in a downstream direction by the gas flow. In a preferred form of this alternative embodiment, a downstream section of the apparatus provides supersonic turbulent cooling of the severed and displaced arc portion thereby contributing to the dielectric recovery between said electrodes.

The present invention, in other aspects, provides a velocity at the throat which is elevated to sonic or near-sonic velocities with sufficient dynamic force to cause arc severing and displacement, by using a high stagnation enthalpy gas flow, typically at least as great as 400 Joules per gram, taken at zero velocity and relative to absolute zero temperature, but preferably as high as 4,000 Joules per gram. The present invention, as will be seen, takes advantage of flow velocities developed in the apparatus to shear or otherwise sever an arc formed at an electrode upstream of a flow-confining duct.

A number of unique principles are employed by the present invention to withstand a transient system recovery voltage encountered during an arc clearing event. For example, the electrical continuity of the interelectrode arc plasma is made to cross a flow boundary adjacent the upstream electrode and most preferably the flow boundary crosses the plasma adjacent the arc root formed at the upstream electrode. This applies forces to the arc plasma causing a shearing at or near the boundary. The severed plasma is displaced away from the upstream electrode by a near-sonic flow of high enthalpy gas, keeping the increasing dielectric strength of the lengthening dielectric gap continuously greater than the transient network voltage recovering across the current interrupting apparatus. If desired, the severed portions of the arc plasma (i.e., those portions of the post-zero residual arc plasma formed by the aforementioned plasma severed and displaced from the upstream electrode) can be cooled with supersonic turbulent cooling to obtain further performance improvements. In a preferred embodiment of the present invention, supersonic turbulent cooling of the displaced plasma portions is added to the aforementioned plasma severing and displacement and provides an improvement in the dielectric arc interrupting performance.

Other objects, advantages and features of the present invention will become apparent from studying the appended description and accompanying drawings.

BRIEF DESCRIPTION OF THE DRAWINGS

In the drawings wherein like elements are referenced alike:

FIG. 1 is a cross-sectional view of an arc severing and displacing apparatus shown in conjunction with an alternating current power source and a single-phase load serving power line experiencing an electrical fault;

FIG. 2 is a cross-sectional view similar to that of FIG. 1, but showing operation of the apparatus after the fault has been detected and the movable contact has drawn an arc in the flow direction of a dielectric gas flowing from a source to a region of lower pressure, which may be the ambient atmosphere;

FIG. 3 is a cross-sectional view of the same interrupter as the residual arc plasma is being displace from the upstream wall electrode from which it was severed a few microseconds after a natural alternating current zero;

FIG. 10 is a cross-sectional elevational view of an arc severing and displacing apparatus, which is operated by combustion of a solid propellant, during conduction of load current;

FIG. 11 is a cross-sectional elevational view of the same interrupter in FIG. 10 after a fault has been detected and expansion of propellant gases have moved one contact to the open position and transferred the upstream arc terminus to a stationary wall electrode;

FIG. 12 is a cross-sectional elevational view of the same interrupter in FIGS. 12 and 13 after a current zero showing displacement of the residual arc away from the wall electrode from which it was severed by the expansion cooled propellant gases.

DETAILED DESCRIPTION OF THE PREFERRED EMBODIMENTS

1. Prior Art Gas Circuit Breakers

The principle of fault current interruption in present art circuit breakers is essentially the same for present day interrupting mediums, including oil, air, or SF6. The arc is drawn in a high pressure gas having large pressure gradients in the axial direction of the arc. The gas flow path generally includes a converging section to accelerate both the relatively cool dielectric interrupting gas and the hot arc plasma to their respective sonic velocities. This is followed immediately by a diverging flow length to accelerate both gases to supersonic velocities and to subject residual arc to flow turbulence to increase the rate at which it is cooled from a high temperature plasma (>1E4 K) to a nonconductive dielectric gas (<E3 K) during the time period in which network voltage recovers across the now open breaker contacts. A good survey of the technology now used in present art circuit breakers is given by K. Ragaller, et al. (Ref. 1, Current Interruption in High-Voltage Networks, K. Ragaller, editor, Plenum Press, New York, 1978).

Figure 4:
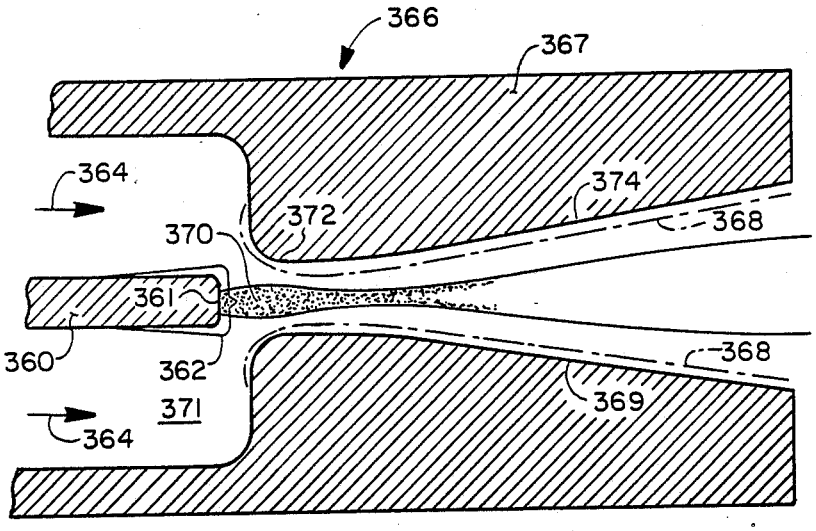
FIG. 4 is a cross-sectional view of a prior art current interrupting apparatus with arc cooling showing arc termination at an upstream electrode which is surrounded by the dielectric gas flow.

A high voltage circuit breaker which is typical of the present art is shown in FIG. 4, generally as 366. The high pressure end of the arc 370 terminates on upstream electrode 360. A low enthalpy (low temperature, high molecular weight) gas 364 flows through a Laval (converging-diverging) nozzle 367 composed, in the single nozzle design shown, of a dielectric material. The flow velocities of both gases, interrupting gas 364 and plasma 370, is subsonic upstream of throat 372 and supersonic downstream in the diverging nozzle section 374, where turbulent cooling dominates during both the thermal and dielectric recovery periods The early stage of this arc cooling process, immediately after current zero is dominated by radiant cooling. However, the final transition from a low temperature conductive plasma (<5E3 K) to a dielectric gas is governed by turbulent heat transport and requires several tens of microseconds. It is during this period that increasing voltage across the cooling residual arc path produces small post-zero currents which heat the residual plasma by Joule heating. If the turbulent cooling rate becomes less than the Joulian reheating rate, the residual path will reheat to arc temperatures, which is termed a thermal reignition or a thermal failure to interrupt the fault current.

Figure 6:
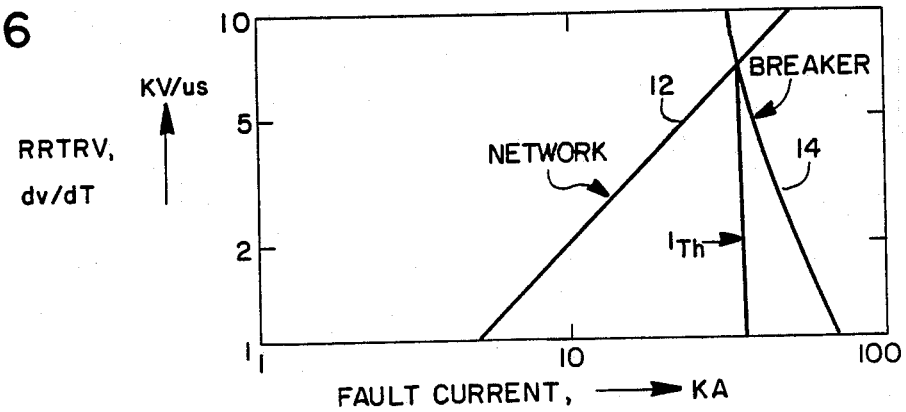
FIGS. 6–7 are graphical representations showing performance of prior art gas circuit breakers where supersonic turbulent cooling with low enthalpy gases is the dominant mechanism for current interruption and recovery voltage withstand.

The thermal recovery performance of a typical present art circuit breaker is shown in FIG. 6. The rate of rise in transient recovery voltage (RRTRV) against which the breaker can successfully avoid thermal arc reignitions is a strong function of the available fault current, as shown by breaker curve 14. The RRTRV which the network imposes across the opening breaker contacts, which varies with the location of the circuit breaker in the system, increases linearly with available fault current, as shown in the network line 12. Fault currents above the limiting value Ith will produce higher RRTRV than the breaker can interrupt against and thermal failures to interrupt the fault current will occur. In general, the highest RRTRV occurs for short line faults some kilometers from the interrupter.

After the residual plasma has been cooled sufficiently to behave as a nonconductive dielectric gas, it must withstand the peak transient recovery voltage (PTRV) of the network approximately a hundred microseconds or more after current zero. If not, a sudden dielectric breakdown will occur and an arc will reform between the contacts, termed a dielectric reignition or dielectric failure to withstand the recovery voltage.

Figure 7:
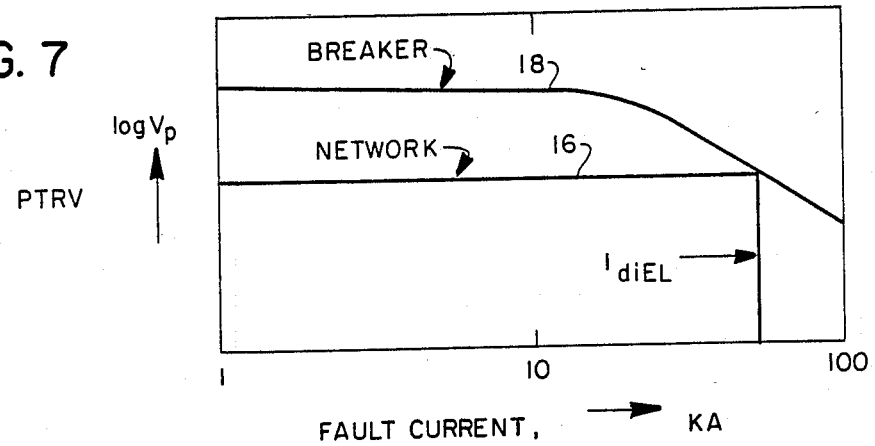

The dielectric recovery performance of a typical present art circuit breaker is shown in FIG. 7. The dielectric performance of the breaker drops off at high fault currents, curve 18, while the PTRV which the network produces, line 16, remains constant. Fault currents above the limiting value Idiel will result in a dielectric failure to withstand the recovery voltage. Generally, dielectric failures are most likely for terminal faults close to the interrupter.

The thermal and dielectric recovery performance of present art breakers are strongly dependent on fault current magnitude, as shown in FIGS. 6 and 7. This is due to the increasing diameter of residual arcs with increasing fault current. More time is required to cool the larger diameter arcs from their outside surfaces by turbulent diffusion. With increasing times required for cooling the larger arcs, the network transient recovery voltage across the interrupter reaches higher values, making thermal and dielectric reignitions more likely.

The upstream electrode 360 in present art, single nozzle breakers is generally solid and surrounded by the flow of interrupting gas 364 as shown. To minimize the length of subsonic plasma, for reasons given in the copending application No. 07/205,660, the upstream electrode is positioned close to nozzle throat 372. However, it cannot be too close or it will interfere with the flow of interrupting gas 364. As will be seen below, the present invention provides means for avoiding this compromise and allows optimum positioning of the upstream electrode, even at the nozzle throat.

FIG. 4 shows that the flow boundary layer 368 adjacent nozzle 367 as physically separate from the boundary layer 362, which is adjacent electrode 360. These two boundary layers are separated by the high velocity flow of interrupting gas 364. The physical significance of this will become apparent below when the wall electrode of the present invention is described further.

Gas circuit breakers presently store their interrupting gas continuously at ambient temperature (300 K) and moderate pressures, typically greater than 10 atmospheres. These gases have high molecular weights, e.g. air at 29 and SF6 at 146. These gases have absolute stagnation enthalpies generally less than 300 J/gm. This contrasts greatly from the present invention which may utilize high enthalpy interrupting gases, on the order of 400 to 4,000 Joules/gm, obtained by high temperature (<2E3 K), low molecular weight (approximately 10) gases produced from solid material at the time of current interruption.

2. Arc Severing and Displacement

Figure 1:
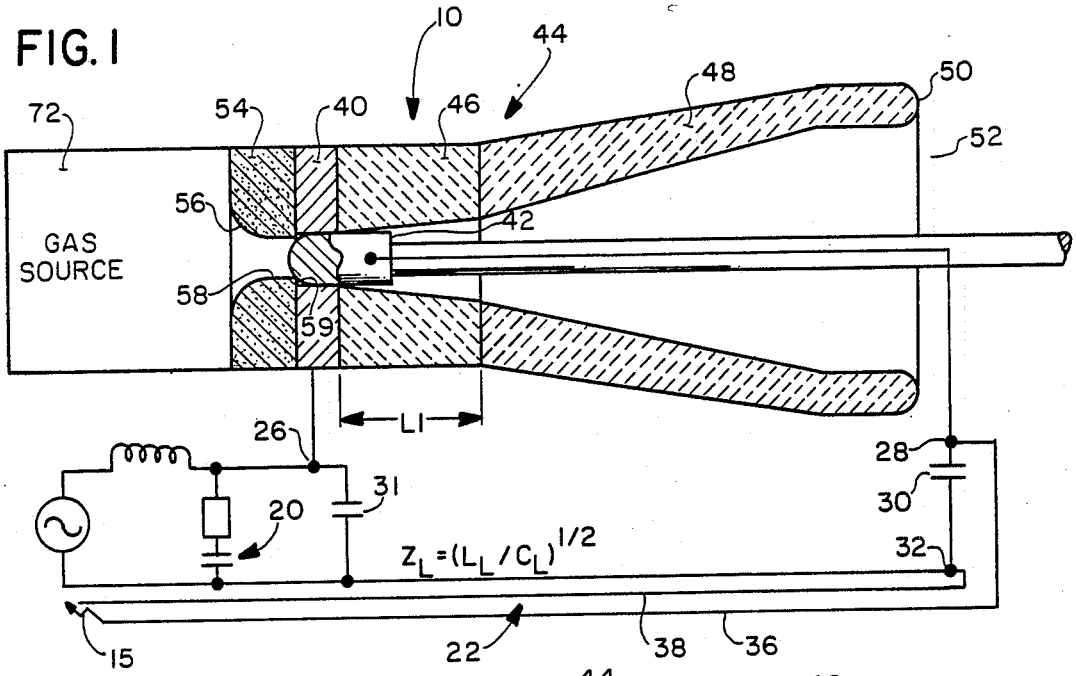
FIGS. 1–3 show cross-sectional views of an arc severing and displacing apparatus in a chronological sequence of interrupting a fault in a high voltage electrical power system.
Figure 2:
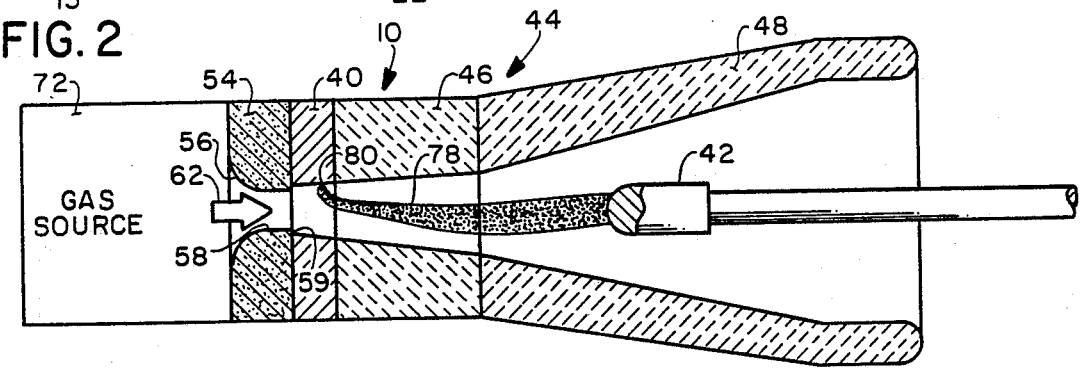
Figure 3:
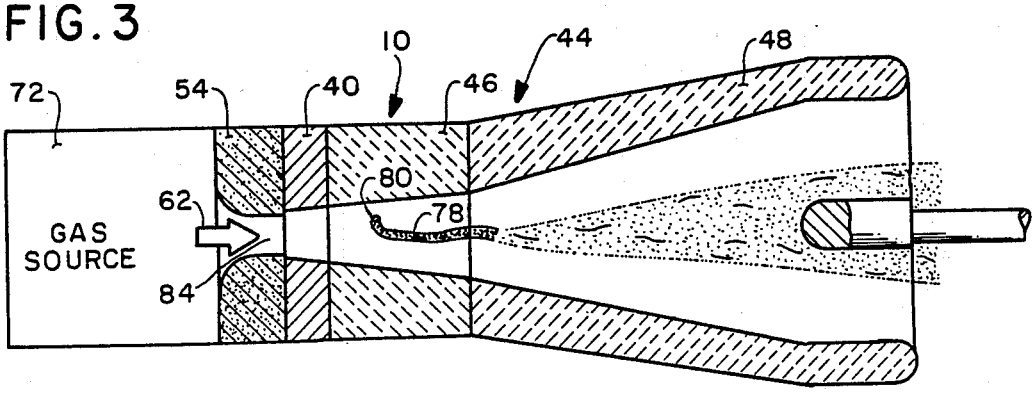

The present invention discloses new methods and apparatus of interrupting high currents in high voltage electrical power networks. Referring initially to FIGS. 1–3, the upstream arc terminus is severed from the high pressure electrode 40, within a few microseconds after a current zero and the severed plasma displaced downstream by a high enthalpy, high dielectric strength gas at near sonic velocity. The thermal recovery period occurs in much less time and at lower values of recovery voltage than with present art interrupters, making thermal arc reignitions less likely. Dielectric recovery occurs by displacing the severed plasma with a high dielectric strength gas from gas source 72 at near sonic velocity. The gas source will be described further, herein.

The rate of dielectric recovery is the product of the dielectric strength of the interrupting gas, its near sonic velocity and its near sonic flow pressure, the product of which can be made to exceed the dielectric performance of present art circuit breakers, especially those which use air as the interrupting and insulating medium.

FIGS. 1–3 show cross-sectional views of a high voltage contact circuit breaker or interrupter generally indicated at 10 illustrating a sequence of operation. FIGS. 1–3 are arranged in chronological order, showing the arc severing and displacing provided by the present invention. FIG. 1 shows the interrupter at a point in time during initiation of an electrical fault 15 on load-serving power line 22. FIG. 2 is taken a short time later, after interrupter 10 has responded to the fault by sensing and actuation means (not shown). In FIG. 2, movable electrode 42 has drawn an electrical arc which conducts network current between electrodes 40 and 42. FIG. 3 represents a time shortly after a current zero, when residual arc 78 has been severed from upstream electrode 40 and displaced downstream a short distance into the near sonic plasma displacement section 46 of the flow-confining channel of the conduit 44.

FIG. 1 shows the interrupter 10 interposed between a load serving single-phase power line 22 and a source of alternating current electrical power 20. Capacitors 30 and 31 may be connected at or near the terminals of interrupter 10 if necessary to assure ample arc severing time independently of where interrupter 10 is applied in a network. Alternatively, capacitors 30,31 may be constructed as part of interrupter 10. Movable second, or downstream electrode 42 is in the closed position, in electrical contact with stationary electrode 40, conducting load current from source 20 to line 22. An electrical fault 15 has just initiated on load line 22.

The distributed impedances (inductance, capacitance and resistance) of the source side network 20 are represented in FIG. 1 by lumped impedances which, along with capacitor 31, control the source side transient recovery voltage. The distributed impedances of the load side network 22 are represented in FIG. 1 by surge impedance Z1=the square root of (L1/ C1), since it, with capacitor 30, controls the rate of rise in load side transient recovery voltage.

FIG. 2 represents a flow of dielectric interrupting gas 62 through consecutive stages of subsonic, near sonic and supersonic flow in the axial direction of arc 78. Subsonic gas flow occurs in converging section 54 of conduit 44 up to the sonic throat 58 thereof. Gas flow at near sonic velocity and pressure occurs through the ring shaped, upstream, stationary electrode 40 and through the near-sonic plasma displacement nozzle section 46 of the conduit. Gas flow at supersonic velocities occurs in the diverging expansion section 48 of the conduit.

A step change 59 in flow diameter between converging section 54 and upstream electrode 40 assures that the boundary layer across which the upstream end 80 of arc 78 terminates is turbulent, independent of flow Reynolds number.

FIG. 3 shows the interrupter 10 a few microseconds after the interrupting current zero. Upstream arc terminus 80 of residual arc 78 has been severed from upstream electrode 40 and the severed plasma displaced downstream by the near sonic flow of dielectric gas 62. Prior to severing, the arc terminus 80 is generally perpendicular, or nearly perpendicular to the surface of electrode 40.

The upstream wall electrode 40 plays an important role in the residual arc severing process. Wall electrode 40 and the adjacent downstream dielectric wall of the near sonic section fix the axial position of the arc root, while across the thin (<0.1 cm), turbulent flow boundary layer the body of the residual arc is embedded in the near sonic flow of the high enthalpy dielectric interrupting gas 62, which, is generally transverse or across the arc root. This subjects the arc terminus 80 to the translation and rotation of a high shear flow, which severs the arc from wall electrode 40 and displaces it into the dielectric near sonic plasma displacement section 46. The configuration of the electrodes 40,42 and the direction of travel of moving electrode 42 fixes the arc root generally perpendicular to the flow of dielectric gas at the surface of electrode 40.

At typical fault interrupting ratings for high voltage interrupters, residual arc diameters at current zero are in the range of 0.1 cm. The sonic velocity of the high enthalpy gases of the present invention is about 0.1 cm/microsecond. The body of residual arc 78 is displaced from wall electrode 40 at about one arc diameter per microsecond, thus translating several arc diameters during the first few microseconds following current zero.

In the present invention, the dielectric gas is released from the source when the current in the network approaches zero so as to impart high velocity flow of the dielectric gas along a path intersecting the current-zero arc. In one embodiment, this timing is achieved by the flow confining duct which acts as a clogged nozzle for the solid gas-producing material. The time required for the nozzle to unclog provides the desired time delay to ensure that the desired stagnation enthalpy, stagnation temperature, and stagnation pressure flow conditions obtain at the time of current interruption. As a result, the gas source at the critical time for arc severing and displacement is sufficient to sever the electrical arc from the first electrode 40, and to displace the severed arc portion toward the downstream dielectric surface of duct section 46.

A dielectric interrupting gas having a sufficiently high absolute stagnation enthalpy (relative to absolute zero temperature and at zero flow velocity) also contributes to the arc severing and displacement of the present invention. Using the perfect gas approximation for real gas mixtures, the sonic velocity of a gas is proportional to the square root of the gas enthalpy, or the square root of the ratio of gas temperature divided by the average gas molecular weight. According to one aspect of the present invention, the high sonic velocities required for rapid severing and displacement of the residual arc plasma from the upstream electrode are obtained by a sufficiently high gas enthalpy, which is preferably obtained by using a high temperature, low molecular weight gas mixture produced from solid materials at the time of current interruption.

A. H. Sharbaugh, et al., have shown (Ref. 2, A. H. Sharbaugh, P. K. Watson, D. R. White, T. H. Lee, and A. N. Greenwood, An Investigation of the Breakdown Strength of Nitrogen at High Temperatures Using a Shock Tube, IEEE Trans., Part III, Power Apparatus and Systems, Vol. 80, pp 333–342, 1961) that the dielectric strength of nitrogen gas is 80% of its room temperature value at 2,000 K. and over 50% at 3,000 K. For theoretical reasons, other gases having similar ionization potentials should behave similarly. Gas mixtures having absolute stagnation temperatures <2E3 K can be used for arc severing and displacement in the present invention without undue loss of dielectric strength.

The preferred gas source uses a nitrogen-containing ballistic propellant in combination with a material serving as a source of dielectric gas. The solid material is ablated by heat from the electrical arc, or heat from the gaseous products of combustion to generate the dielectric gas. Those skilled in the art will readily appreciate that any number of solid material gas sources can be provided to achieve the desired gas flow parameters at the time of current interruption, as taught in accordance with the present invention The gas flow parameters of the present invention include an absolute stagnation enthalpy of at least 400 Joules/gram; absolute stagnation temperature greater than 325 K; and an absolute stagnation pressure greater than two atmospheres. In addition, the preferred dielectric gas (that gas composition in contact with the arc) has an average molecular weight of less than 28. Preferably, the dielectric gas includes hydrogen.

If the average molecular weight of air, 29, is to be significantly lowered, hydrogen, with its diatomic molecular weight of 2, should be used in the gas mixture. It has not been safe to use tanks of pressurized hydrogen in prior art interrupters, because of the danger of explosion and fire. However, hydrogen has been tested in laboratory scale circuit breakers by H. O. Noeske (Ref. 3, H. O. Noeske, Arc thermal recovery speed in different gases and gas mixtures, IEEE Trans., Vol. PAS-100, No. 11, November 1981) and compared with SF6, nitrogen and other gases. He found hydrogen, H2, and methane, CH4, gas to be two orders of magnitude faster than pure SF6 and three orders of magnitude faster than nitrogen, which should be similar to air (70% nitrogen). Those are astonishing numbers and emphasize the importance of finding safe means of using hydrogen in high voltage current interrupters.

The present invention preferably contemplates the use of hydrogen for high voltage current interruption by storing it in polymeric solids, which are combusted or ablated into gas mixtures containing significant quantities of hydrogen gas at the time it is needed for current interruption. This limits the quantities of hydrogen produced to safe levels, which can be vented safely to the atmosphere. Prior art oil circuit breakers also use hydrogen rich gases as current interrupting medium, but the quantity of hydrogen containing oil is much greater, even in minimum oil breakers, than needed for the arc severing and displacement means and the improved supersonic turbulent cooling means disclosed here.

The distributed and stray capacitances associated with high voltage lines and interrupters is generally sufficient to delay the beginning of the recovery voltage for about three to five microseconds. This is usually sufficient for the arc severing process to be completed. If it is necessary to provide more time for the arc severing process, lumped capacitors can be added to the load side terminal (capacitor 30) and/or to the source side terminal (capacitor 31). Because the arc severing time of the present invention is shorter than the thermal recovery time in present art breakers, capacitors 30 and 31 will be smaller than is typically used with present art breakers.

The near sonic plasma displacement nozzle section 46 plays an important role in the dielectric recovery of the present invention. It maintains the flow velocity and flow pressure of the dielectric interrupting gas 62 at values close to those at sonic conditions, which exists at minimum flow section or throat 58. The rate at which an arc severing and displacing interrupter of the present invention recovers dielectric strength, typically given in kV/microsecond, is the product of the gas dielectric strength (kV/cm/atm), the near sonic velocity (cm/microsecond) and the near sonic flow pressure (atm). If the flow was allowed to diverge downstream from the throat, as done in present art breaker nozzles, the velocity would increase, but the flow pressure would drop much faster, making the overall dielectric recovery rate (kV/microsecond) lower. The divergence in the diameter of the near sonic section has been exaggerated for clarity only. Actually it is small, only enough to accommodate a boundary layer which thickens with flow distance, keeping the area of near sonic flow nearly constant.

The length L1 of the near sonic section is important since it plays an important role in maintaining the high dielectric strength flow by maintaining the near sonic flow pressure until after the peak recovery voltage stress (kV/cm) has passed. This peak recovery voltage stress is usually due to load side voltage oscillations which peak in tens of microseconds after current zero. The high enthalpy dielectric interrupting gases 62 employed in the present invention, have sonic velocities of about 0.1 cm/microsecond, requiring a length L1 for the near sonic section of several centimeters. The near-sonic nozzle section is distinguished from the supersonic turbulent cooling means in present art breakers which use converging-diverging (Laval) nozzles having no such near sonic nozzle section.

The diverging nozzle section 48 may not be necessary for some fault clearing applications. However, when employed, it can provide additional advantages, such as shielding the surroundings from the arcing process and diffusing the flow to low velocities after it traverses the shock from supersonic to subsonic flow.

Figure 13:
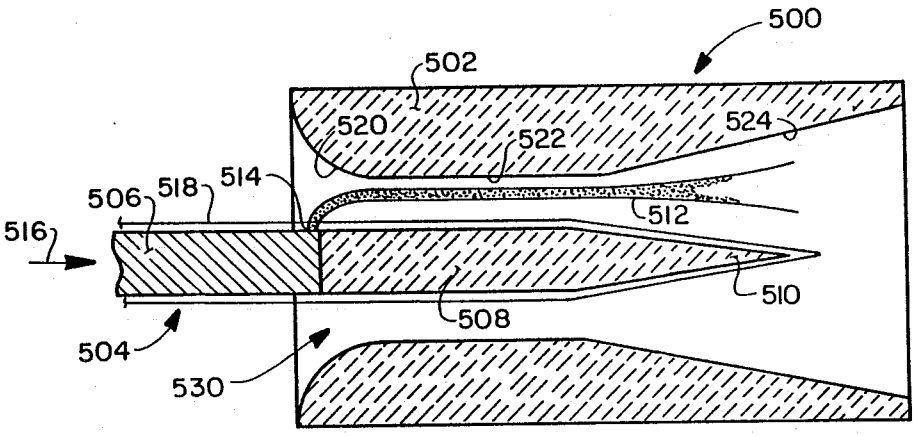
FIG. 13 is a cross-sectional view of another alternative embodiment of an arc severing and displacing apparatus illustrating further features of the present invention.

The upstream wall electrode 40 employed in the preferred embodiment of the present invention is preferably ring shaped and surrounds the flow of dielectric interrupting gas as shown in FIGS. 1, 2 and 3. The present invention also contemplates the alternative arrangement, which is illustrated in FIG. 13. The current interrupting apparatus 500 includes an outer dielectric body 502 which defines a confined channel, partly surrounding a central or inner structure generally indicated at 504. The inner structure 504 includes an upstream metallic electrode 506 having a cylindrical body, and an adjacent downstream insulating body 508 having a generally cylindrical configuration and terminating at a streamlined conical tip 510.

An arc 512 extends from electrode 506. Due to the gas velocity, the arc will either be initially formed at, or will quickly migrate to the end portion of electrode 506, which is closest to the downstream insulating body 508. A flow in the direction of arrow 516 will set up a flow boundary layer 518 spanning both the electrode 506 and the adjacent downstream insulator body 508, and will cut across the root end 514 of arc 512. The arc root is subjected to gas dynamic forces which tend to force the arc off of the upstream electrode wall surface and onto the insulator wall surface as the fault current approaches zero.

The outer insulating body 502 includes an upstream converging nozzle portion 520, an intermediate near sonic portion 522 and a downstream diverging portion 524. The near sonic portion 522 preferably is slightly diverging but, if desired, may be made cylindrical or even slightly converging.

The present invention also contemplates that the dielectric wall surface could be separated a small distance from the upstream wall electrode surface, and thus be located adjacent the wall electrode surface. The term "adjacent" as used herein to describe the relative relationship between an upstream electrode and its neighboring downstream insulator contemplates some distance, approximately one current zero arc root diameter. Thus, there could be up to one millimeter separating the "adjacent" downstream dielectric wall from the upstream wall electrode. This permissible, but less preferable separation is not shown in the figures.

High voltage current interrupters built according to the principles of the present invention will have higher pressure requirements for the dielectric interrupting gas at current zero when applied on overhead power lines than when applied on underground power lines. This is due to the higher surge impedance of the overhead lines which may be an order of magnitude greater than that of underground lines. The load side RRTRV is proportional to the surge impedance of the faulted line. The higher rates of rise in load side transient recovery voltage requires higher near sonic flow pressures in the dielectric plasma displacement gas to avoid dielectric arc reignitions.

FIG. 1 shows the surge impedance of line 22 to be equal to the square root of the ratio of line inductance to line capacitance, both per unit length. Overhead lines have large spacings in air, resulting in large inductance and low capacitance, large surge impedance and large load side RRTRV. In contrast, underground power lines typically have solid insulation between closely spaced high voltage lines and ground surfaces. This results in much lower line inductances, higher line capacitances, lower surge impedances and lower load side RRTRV.

Figure 5:
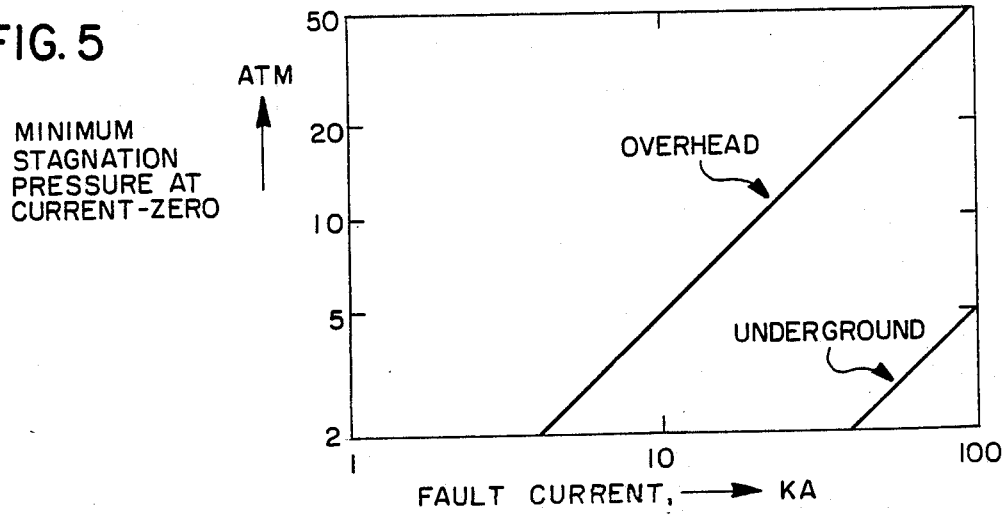
FIG. 5 is a graphical representation showing minimum pressure requirements for arc severing and displacing apparatus serving loads connected to overhead and underground power lines.

FIG. 5 shows an example of the minimum stagnation pressure requirements at current zero for an arc severing and displacing interrupter according to the principles of the present invention. These pressure requirements are moderate. Even for the extreme requirements of 100 kA rating in an overhead application, the peak apparatus pressure will not greatly exceed 100 atmospheres. The pressure requirements are very low for underground applications.

2.1 AS&D Circuit Breaker

Figure 10:
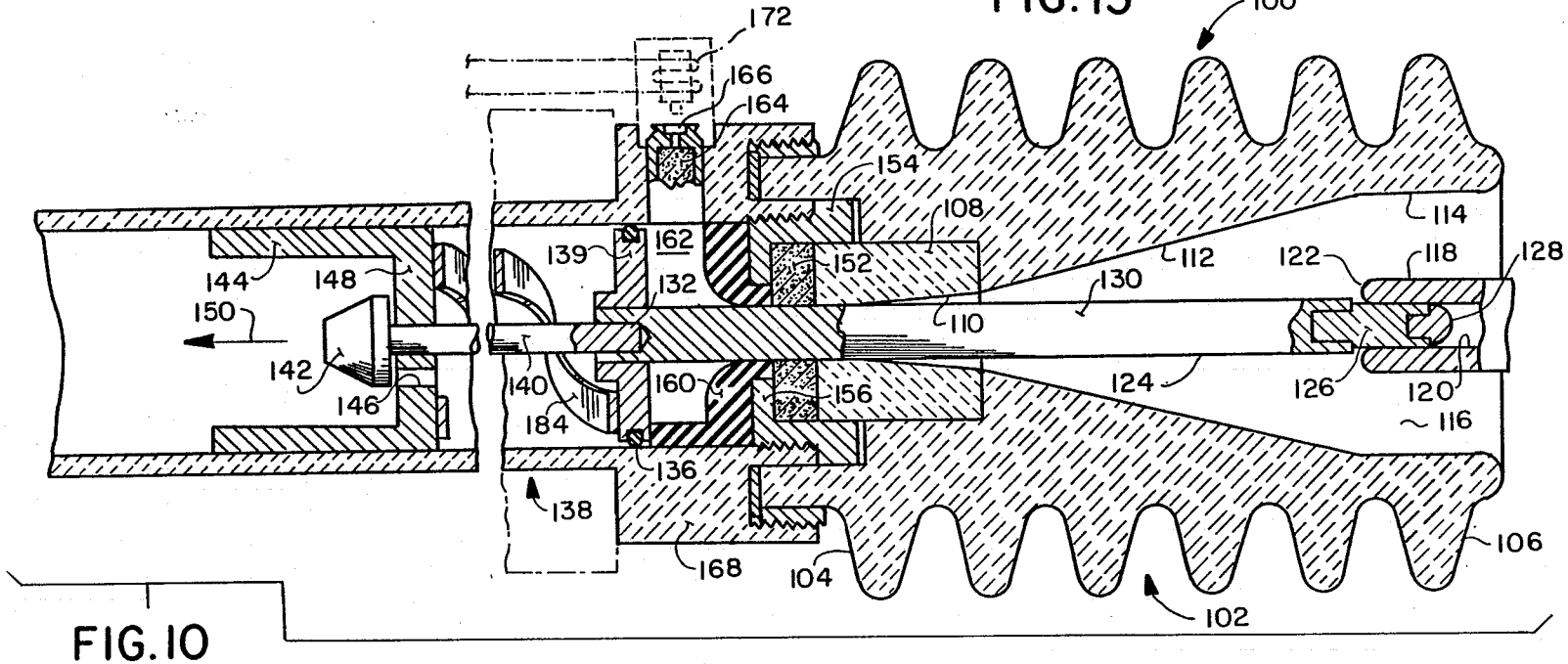
FIGS. 10–12 are cross-sectional elevational views of an alternative embodiment of the arc severing and displacing apparatus according to other features of the present invention and showing a chronological sequence of current interruption.
Figure 11:
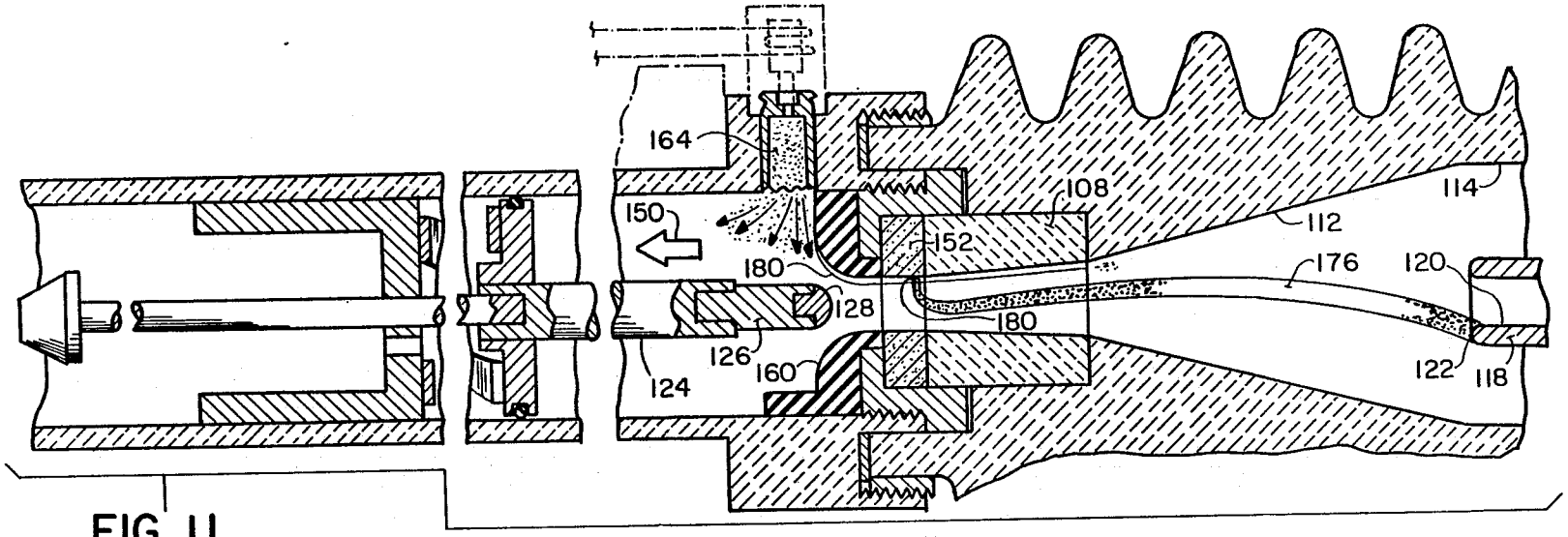
Figure 12:
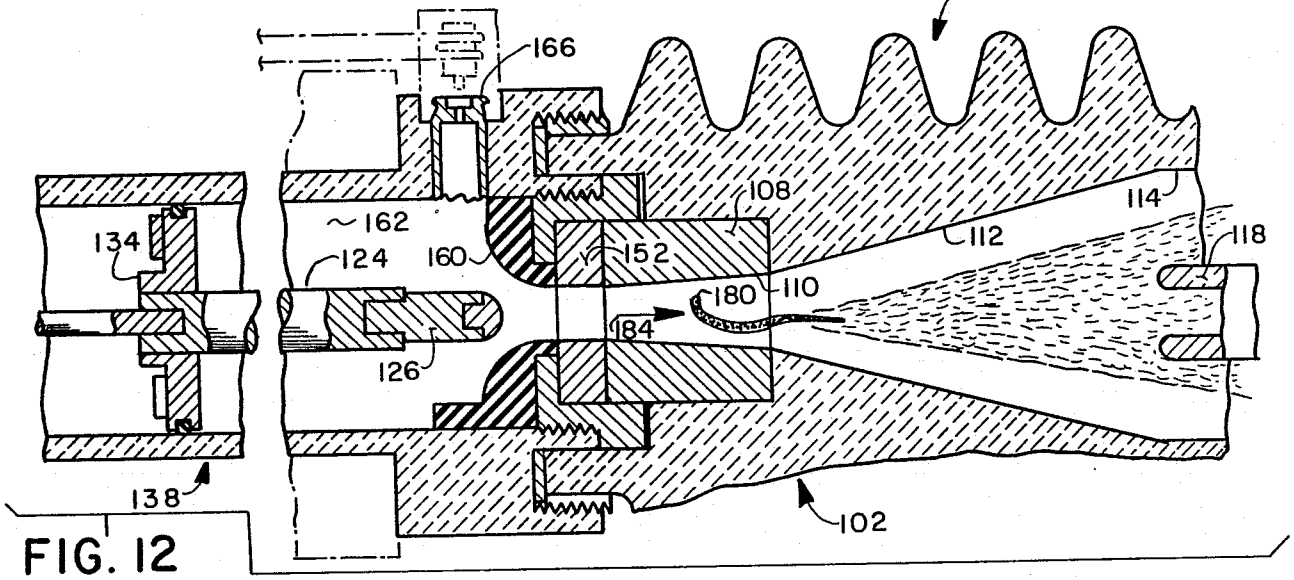

FIGS. 10–12 are cross-sectional elevational views of a contact circuit breaker designed to interrupt currents in high voltage networks according to the arc severing and displacing principles of the present invention. FIG. 10 shows the apparatus in the continuous load current configuration prior to a fault. FIG. 11 shows the interrupter after a fault has occurred and the contacts have been fully opened. FIG. 12 illustrates the interruption processes following a current zero.

Apparatus of FIG. 10 operates entirely on the energy of combustion of a solid propellant 164. The large volumetric expansion of the combustion process operates the mechanism and provides the dielectric displacement gas to interrupt the arc. A description of the operation of the device follows.

Upon detection of a fault by conventional means not shown, solenoid 172 fires primer 166 igniting propellant 164 which burns in chamber 162 producing a high pressure gas with an absolute temperature in the 3E3 K range. Pressure acting on piston 139 withdraws movable contact 126 from stationary contact 118, drawing an arc between them. As the gas in chamber 162 does the work of expansion on piston 139, its temperature drops and recombination of ions and free electrons occurs to create a dielectric gas.

FIG. 11 illustrates the configuration of interrupter 100 at the end of the expansion process, with electrode 126 in the fully open position. As electrode 126 passed through the stationary upstream electrode 152, the upstream arc terminus transferred from 126 to 152, which is located just downstream from the sonic throat of converging nozzle 160. Withdrawal of contact rod 124 and attached electrode 126 from converging nozzle section 162, which may also serve as an elastic seal, initiates the flow of dielectric interrupting gas around and along the arc 176. The expanded and cooled propellant gases flow from high pressure chamber 162 through converging section 160, upstream wall electrode 152, near sonic section 108 and diverging nozzle section 112 to a low pressure chamber or the atmosphere.

FIG. 12 shows the arc severing and displacing process following a current zero. The high pressure arc terminus 180 has been severed from upstream electrode 152 and displaced downstream into near sonic flow section 108. The lengthening dielectric gap between plasma 180 and electrode 152 contains displacement gas having dielectric strength, near sonic velocity and flow pressure which determines the increasing breakdown voltage resisting network voltage recovering between the two conductors. The length of near sonic section 108 is sufficient to maintain the near sonic flow pressure and therefore the high gas dielectric strength until after the peak transient recovery voltage stress between 152 and 180 has passed. Following evacuation of chamber 162, the long term recovery voltage between electrodes 152 and 118 is insulated by propellant gases if retained in a low pressure chamber or by air if vented to the atmosphere.

Combustible solid 164 in FIG. 10 may be based on nitrogen compounds such as nitrocellulose typically used in ballistic propellants. To increase the hydrogen content and lower the average molecular weight of the gaseous products of combustion, powders rich in hydrogen, such as polyethylene or polypropylene, may be added to the charge. Alternately, the high temperature combustion gases may be forced to flow through small bores in an ablator material rich in hydrogen. This means, which is not shown in the drawing, has the additional advantage of increasing the combustion pressure and thereby the propellant burning rate. This may be desirable since ballistic applications have chamber pressures in the range of 10,000 to 100,000 psi, much higher than that required for the arc severing and displacing means of the present invention.

3. Improved Supersonic Turbulent Cooling With AS&D

If desired, the arc severing and displacing means of the present invention can be used with supersonic turbulent cooling means of some prior art high voltage current interrupters. The thermal diffusivity of a gas is proportional to the square root of its enthalpy, just as is the gas sonic velocity. Therefore, the sufficiently high enthalpy gas which is required for arc severing and displacement also improves the supersonic turbulent cooling used in prior art high voltage interrupters. The two means can be in physical and electrical series, with their dielectric recovery strengths adding. Since diffusion cooling of the residual arc in a diverging turbulent flow is more rapid with the high enthalpy interrupting gases of the present invention, the residual arc is cooled to a dielectric gas more quickly and gains dielectric strength more rapidly than with the low enthalpy interrupting gases of the prior art. After the diffusion cooled residual arc in the diverging nozzle section becomes dielectric, the transient recovery voltage imposed by the network across the interrupter divides between the supersonic turbulent cooling process in the diverging nozzle section and the arc severing and displacing process in the near sonic nozzle section. That results in an improvement in the dielectric recovery performance of an interrupter which uses both means.

Figure 8:
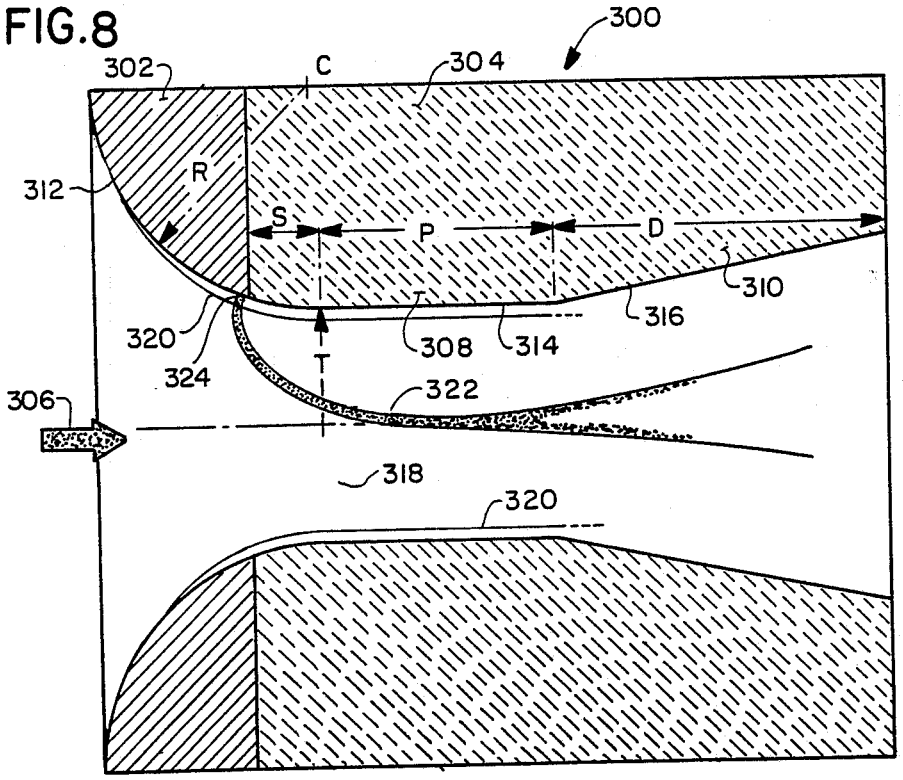
FIG. 8 is a cross-sectional view of an arc severing and displacing apparatus according to principles of the present invention, which additionally retains and improves the supersonic turbulent cooling means of prior art devices.

FIG. 8 shows a cross-section of an interrupter nozzle, at a time near a current zero, which combines the arc severing and displacing means of the present invention with the supersonic turbulent cooling means of prior art interrupters. The upstream arc terminus 324 is located a minimum distance S upstream from the sonic throat located at T. This is necessary to assure that the plasma is accelerated to its sonic velocity by the time it reaches the throat, which in turn is necessary if it is to reach supersonic velocities by diverging flow in nozzle section 310. Turbulent cooling results from the high velocity and density differences between the hot plasma and the relatively cool interrupting gas mixture. A high velocity difference requires a sonic-to-supersonic plasma.

Most of the pressure drop in the converging nozzle section 312 occurs close to sonic throat T. Therefore, the minimum acceleration distance S for the plasma to become sonic at the throat is small, approximately half the radius at throat T. Increasing distance S beyond that required for sonic and supersonic plasma at the throat and in the diverging section respectively is disadvantageous. It increases the current zero diameter of the residual arc and increases the time required to turbulently cool the residual arc to a dielectric gas.

Figure 9:
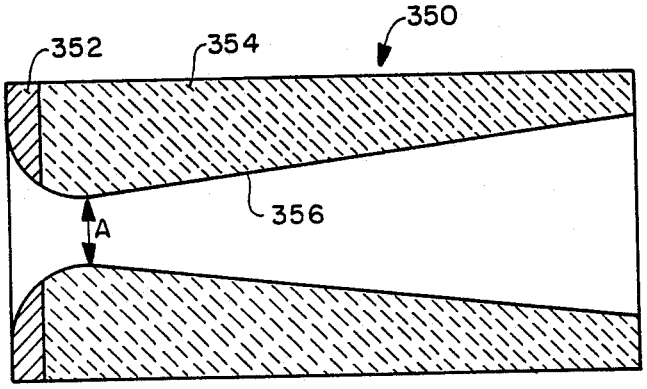
FIG. 9 is another alternative embodiment of an arc severing and displacing apparatus which retains supersonic turbulent cooling and has the form of a deLaval nozzle.

There are combinations of current and voltage ratings for interrupters for which the length of the near sonic section becomes very short, approaching the Laval (converging-diverging) nozzle configuration of the prior art. FIG. 9 shows such a nozzle, with the upstream electrode 352 located upstream from the sonic throat a distance approximately equal to throat diameter A.

The apparatus of FIG. 13 may use the arc severing and displacing means of the present invention by itself, or in combination with prior art supersonic turbulent cooling means, and such may be accomplished merely by changing the location of upstream arc terminus 514 at the time of current interruption.

The high voltage interrupters contemplated by the present invention require a current zero for current interruption and recovery voltage withstand. In alternating current networks, such current zeros occur naturally at twice system frequency. Currents in direct current networks are interrupted by creating a current zero in the interrupter arc. Those skilled in the art will recognize that the new current interrupting means disclosed here may be used in D.C. networks in the same ways that prior art high voltage interrupters have been.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for interrupting currents in a high voltage network, comprising:

a source of a dielectric gas adapted for extinguishing an electric arc;

conduit means defining a confined channel for conveying said dielectric gas along a path from said source through the confined channel;

a first electrode disposed in said conduit means having an exposed surface in said confined channel generally parallel to the direction of gas flow therethrough;

a second electrode in conductive relation with said first electrode during normal operation and disposed downstream from said first electrode at the time of current interruption;

said first and second electrodes having means for conductive connection to a current path in the high voltage network;

a dielectric surface exposed in said confined channel generally parallel to the direction of gas flow therethrough, downstream from said first electrode and contiguous with the exposed surface of said first electrode to form a substantially continuous surface; and means for releasing said dielectric gas from said source when the current in the network approaches zero so as to impart high velocity flow of the dielectric gas over said substantially continuous surface along a path intersecting an electrical arc formed between said first and second electrodes and so as to sever the electrical arc from said first electrode, and displace the severed arc portion toward said dielectric surface.

2. The apparatus according to claim 1 wherein said dielectric gas has an absolute stagnation enthalpy of at least 400 Joules/gram.

3. The apparatus according to claim 1 wherein said dielectric gas has an average molecular weight of less than 28.

4. The apparatus according to claim 1 wherein said dielectric gas comprises hydrogen.

5. The apparatus according to claim 1 wherein said dielectric gas has an absolute stagnation temperature greater than 325 K.

6. The apparatus according to claim 1 wherein said dielectric gas has an absolute stagnation pressure greater than two atmospheres.

7. The apparatus according to claim 1 wherein said dielectric gas source includes means for providing a dielectric gas by combustion of solid material.

8. The apparatus according to claim 7 wherein said solid material comprises a nitrogen-containing ballistic propellant.

9. The apparatus according to claim 1 wherein said dielectric gas source includes means for providing a dielectric gas by ablation.

10. The apparatus according to claim 6 wherein said conduit means includes a section for maintaining the gas flow through said confined channel at near sonic velocities and for maintaining the pressure of the gas in contact with said electric arc plasma until the peak recovery voltage stress has passed.

11. The apparatus according to claim 1 wherein said conduit means includes a throat located immediately adjacent said contiguous edge between said first electrode and said dielectric surface.

12. The apparatus according to claim 1 wherein said conduit means includes a throat located downstream from said contiguous edge, between said first electrode and said dielectric surface and spaced from the first electrode by a distance at least as great as half the radius of said throat during current-zero conditions.

13. The apparatus according to claim 1 further comprising capacitor means in conductive relationship with said first and second electrodes, respectively.

14. The apparatus according to claim 1 wherein said arc is initiated by the separation of electrical contacts.

15. The apparatus according to claim 1 wherein said arc is initiated by the melting of a fusible conductor.

16. The apparatus according to claim 1 wherein said arc is initiated by the breaking of a conductor.

17. The apparatus according to claim 1 wherein said continuous surface forms a portion of said duct so as to at least partially surround said dielectric gas flow path.

18. The apparatus according to claim 1 wherein said continuous surface is disposed within and spaced apart from said conduit means so as to be surrounded by said dielectric gas flow path.

19. A method of severing and displacing an arc extending between a first electrode and a second downstream electrode, comprising:

providing a confined channel for conveying a dielectric gas along a flow path between said first and said second electrodes;

providing a surface on said first electrode exposed to the flow path generally parallel thereto;

providing a dielectric surface exposed to the flow path, generally parallel thereto downstream of the first electrode surface and substantially continuous therewith;

configuring the first and second electrodes so that an arc extending therebetween has an arc root portion which is generally perpendicular to the flow path at the electrode surface;

flowing said dielectric gas over said dielectric surface and said first electrode surface at a high velocity when the current in the network approaches zero, so as to intersect the arc root portion and sever the electrical arc from said first electrode and displace the severed arc portion toward said dielectric surface.

20. The method of claim 19 wherein the dielectric gas has a stagnation enthalpy of at least 400 Joules per gram.

21. The method of claim 19 wherein the dielectric gas has a stagnation enthalpy of at least about 4,000 Joules per gram.

* * * * *